US009068569B2

(12) United States Patent
Speer et al.

(10) Patent No.: US 9,068,569 B2
(45) Date of Patent: Jun. 30, 2015

(54) INTERNAL GEAR PUMP HAVING AN INTERNALLY TOOTHED RING GEAR SUPPORTED IN A ROTATABLE BEARING

(71) Applicant: Robert Bosch GmbH, Stuttgart (DE)

(72) Inventors: Harald Speer, Freiberg (DE); Norbert Alaze, Markgroeningen (DE); Karl-Heinz Hach, Schweiberdingen (DE); Andreas Klein, Dresden (DE); Edgar Kurz, Heilbronn-Horkheim (DE)

(73) Assignee: Robert Bosch GmbH, Stuttgart, DE (US)

( * ) Notice: Subject to any disclaimer, the term of this patent is extended or adjusted under 35 U.S.C. 154(b) by 0 days.

(21) Appl. No.: 14/036,825

(22) Filed: Sep. 25, 2013

(65) Prior Publication Data

US 2014/0086778 A1 Mar. 27, 2014

(30) Foreign Application Priority Data

Sep. 26, 2012 (DE) ..... 10 2012 217 484

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 2/10*** | (2006.01) |
| ***F01C 1/10*** | (2006.01) |
| ***F04C 15/00*** | (2006.01) |

(52) U.S. Cl.

CPC ..... *F04C 2/101* (2013.01); *F01C 1/102* (2013.01); *F04C 2/10* (2013.01); *F04C 15/0019* (2013.01)

(58) Field of Classification Search

USPC ..... 418/19–20, 29–30, 71, 170–171, 166, 418/126–129

See application file for complete search history.

(56) References Cited

U.S. PATENT DOCUMENTS

| | | | | |
|---|---|---|---|---|
| 2,482,713 | A * | 9/1949 | Jones | 418/170 |
| 4,097,204 | A * | 6/1978 | Palmer | 418/19 |

FOREIGN PATENT DOCUMENTS

| | | |
|---|---|---|
| DE | 15 53 035 | 4/1975 |
| DE | 10 2007 050 820 A1 | 4/2009 |
| GB | 1074371 | 7/1967 |
| JP | 50-140902 | 11/1975 |

* cited by examiner

*Primary Examiner* — Theresa Trieu

(74) *Attorney, Agent, or Firm* — Maginot, Moore & Beck LLP

(57) ABSTRACT

An internal gear pump includes a separator arranged in a pump chamber of the internal gear pump. The separator divides the pump chamber into a delivery chamber and a suction chamber and is arranged so as to be radially moveable and capable of pivoting. The internal gear pump further includes a bearing ring in which a ring gear of the internal gear pump is rotatably supported such that it can pivot about a pin. A pressure prevailing in the pump chamber when the internal gear pump is in operation acts on the ring gear and the bearing ring with a torque, which acts inwardly from the pin in a circumferential direction to the suction chamber and presses tooth tips of teeth of the ring gear inwards against the separator and presses the separator inwards against tooth tips of teeth of the pinion.

6 Claims, 1 Drawing Sheet

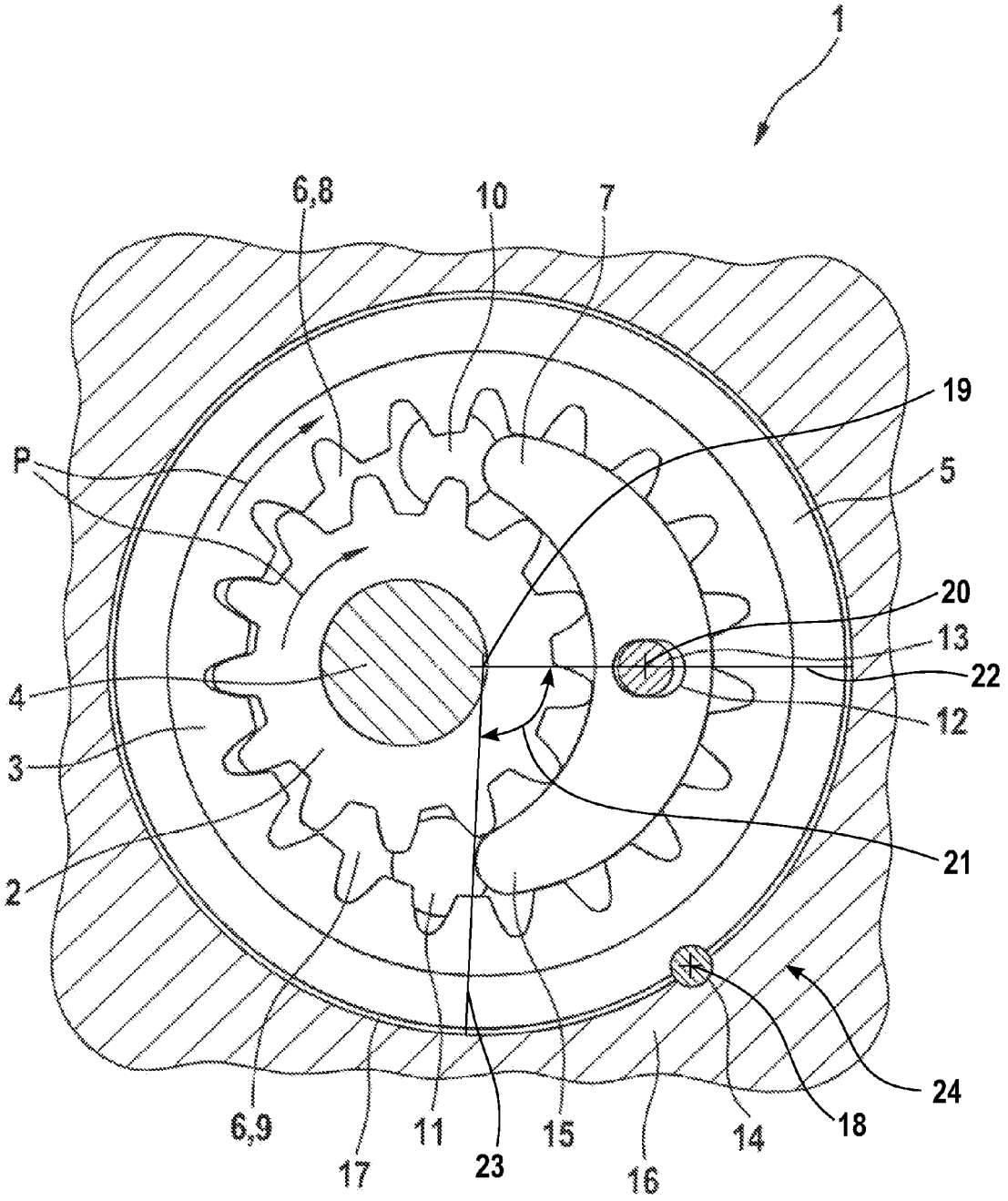
1
6,8
10
7
19
P
5
20
13
22
4
12
3
21
2
24
6,9
11
15
14
18
17
23
16

INTERNAL GEAR PUMP HAVING AN INTERNALLY TOOTHED RING GEAR SUPPORTED IN A ROTATABLE BEARING

This application claims priority under 35 U.S.C. §119 to patent application no. DE 10 2012 217 484.2, filed on Sep. 26, 2012 in Germany, the disclosure of which is incorporated herein by reference in its entirety.

BACKGROUND

The disclosure relates to an internal gear pump having the features of the disclosure. Such internal gear pumps are used, for example, instead of the piston pumps normally used in wheel slip-controlled and/or power vehicle brake systems and are often also referred to as return pumps.

Internal gear pumps are known. They comprise a pinion, that is to say an externally toothed gear wheel, which is arranged eccentrically in an internally toothed ring gear and at a point on the circumference or in a portion of the circumference meshes with the ring gear. The pinion and the ring gear may also be thought of as gear wheels of the internal gear pump. Through rotational driving of one of the two gear wheels, usually the pinion, the other gear wheel, that is to say usually the ring gear, is also driven to rotate and the internal gear pump delivers fluid in a manner known in the art; in a vehicle hydraulic brake system it delivers brake fluid.

Opposite the portion of the circumference in which the pinion meshes with the ring gear, the internal gear pump comprises a crescent-shaped clearance space between the pinion and the ring gear, which is referred to here as the pump chamber. A separator, which divides the pump chamber into a suction chamber and a delivery chamber, is arranged in the pump chamber. Owing to its typical shape the separator is also referred to as the crescent or crescent piece, another term being the filling piece. A typically hollow cylindrical inner side of the separator bears against tooth tips of teeth of the pinion and a typically outwardly curved outer side of the separator bears on tooth tips of teeth of the ring gear, so that the separator encloses volumes of fluid in tooth spaces between the teeth of the gear wheels of the internal gear pump. Rotational driving causes the gear wheels to deliver the fluid in the tooth spaces from the suction chamber into the delivery chamber.

The published patent application DE 10 2007 050 820 A1 discloses such an internal gear pump having a crescent-shaped, one-piece separator, which is pivotally supported at its circumferential or longitudinal center. Directional specifications such as "circumference" or "radial" relate to the internal gear pump. In the event of play between the separator and the tooth tips of the gear wheels the separator can pivot, so that at one end it bears on the tooth tips of the teeth of the pinion and at the opposite end on tooth tips of the teeth of the ring gear. A pressure in tooth spaces of the pinion and the ring gear prevailing when the internal gear pump is in operation produces a torque on the separator, which has a pivoting action and maintains the bearing contact of the one end of the separator against the tooth tips of the teeth of the pinion and of the opposite end of the separator against the tooth tips of the teeth of the ring gear.

SUMMARY

In the internal gear pump according to the disclosure the separator is moveable in a radial direction and the ring gear is rotatably supported in a bearing, which is supported so that it can pivot about a pivot axis. The pivot axis of the bearing is arranged eccentrically in relation to an axis of rotation of the ring gear, so that via the ring gear a pressure, prevailing in the pump chamber when the internal gear pump is in operation and acting internally on the ring gear, exerts a torque on the bearing of the ring gear which externally presses the ring gear against the separator. The ring gear externally pressing against the separator when the internal gear pump is in operation presses the radially moveable separator inwards against tooth tips of teeth of the pinion. An external and internal sealing contact against the separator, which is important for a good volumetric efficiency, is thereby achieved both by the tooth tips of teeth of the ring gear and by teeth of the pinion. Different pressures prevail in the pump chamber; the pressure in the delivery chamber is higher than in the suction chamber. Deciding where to arrange the pivot axis of the bearing depends on the geometric ratios. The pivot axis is preferably arranged so that in the area of the delivery chamber and/or a delivery chamber-side area of the separator the bearing with the ring gear pivots outwards, that is to say away from the pinion, and in a suction chamber-side area of the separator it pivots inwards towards the separator. The high pressure in the delivery chamber is thereby utilized in order to subject the bearing to a torque, which externally presses the ring gear with the tooth tips of its teeth against the separator.

The disclosure affords a simple internal gear pump construction having a one-piece separator, which makes the internal gear pump easy to assemble. A further advantage of the disclosure is that it compensates for manufacturing tolerances and allows larger manufacturing tolerances. Wear to the tooth tips of the gear wheels internally and externally on the separator is also compensated for. In addition, the disclosure allows the tooth tips of the ring gear and the pinion to have a long contact surface against the separator in a circumferential direction, and the internal gear pump, as already stated, has a high volumetric efficiency.

The pivot axis of the bearing is preferably situated outside a circumference of the ring gear. Other designs in which the pivot axis of the bearing is situated inside the circumference of the ring gear are also feasible, however. Although no provision is made as such for translational movement of the separator in a direction other than a radial direction, the disclosure does not preclude this either. The separator is preferably capable of pivoting.

Advantageous embodiments and developments of the disclosure form the subject matter of the dependent claims.

The disclosure proposes that the pivot axis of the bearing of the ring gear be situated in a circular sector which is defined by two radii, that is to say by two straight lines that intersect at the axis of rotation of the ring gear. One of the two radii, that on the suction chamber side, runs inside the separator close to a suction chamber-side end of the separator, in order that via the bearing the torque, which acts on the ring gear due to the pressure inside the ring gear when the internal gear pump is in operation, presses the ring gear inwards against the separator at a suction chamber-side end of the separator. A delivery chamber-side radius of the circular sector, in which the pivot axis of the bearing of the ring gear is situated, runs through the delivery chamber outside the separator close to is delivery chamber side-end. The term "close" means that the delivery chamber-side radius passes so close to the delivery chamber-side end of the separator that the torque, which acts on the ring gear due to the pressure inside the ring gear when the internal gear pump is in operation in the desired direction, that is to say it presses the ring gear inwards against the separator at least at the suction chamber-side end of the separator. It is not necessary for the ring gear to be pressed inwards for the entire length of the separator; the ring gear may be pressed outwards at the delivery chamber-side end of the separator. It is regarded as advantageous for the ring gear to be pressed inwards for a certain proportion of the length of the separator, for example a (suction chamber-side) half or more of a length of the separator. It will be noted by way of clarification that the two radii of said circular sector are straight lines through the axis of rotation of the ring gear, which define the position of the pivot axis of the bearing of the ring gear in a circumferential direction of the internal gear pump.

The disclosure further proposes a pivotal separator and limits the circular sector, in which the pivot axis of the bearing is situated, to a circumferential area which begins on a pivot axis of the separator and extends from there in the direction of the delivery chamber. Shifting the pivot axis of the bearing in the direction of the delivery chamber produces a long circumferential portion on which the tooth tips of teeth of the ring gear are pressed inwards against the separator, that is to say a long contact surface of the tooth tips of teeth of both the ring gear and the pinion against the separator in a circumferential direction.

The internal gear pump according to the disclosure is intended, in particular, as a hydraulic pump for a hydraulic, wheel slip-controlled and/or power brake system of a vehicle. In wheel-slip controlled brake systems for vehicles, hydraulic pumps are referred to as return pumps and are at present largely embodied as piston pumps.

BRIEF DESCRIPTION OF THE DRAWING

The disclosure is explained in more detail below with reference to an embodiment represented in the drawing. The single FIGURE shows a front view of an internal gear pump according to the disclosure.

DETAILED DESCRIPTION

The internal gear pump 1 according to the disclosure represented in the drawing comprises an externally toothed gear wheel, here referred to as a pinion 2, and an internally toothed gear wheel, here referred to as a ring gear 3. The pinion 2 is arranged axially parallel to an eccentrically in the ring gear 3, so that the pinion 2 meshes with the ring gear 3. The pinion 2 is rotationally fixed on a pump shaft 4, which serves for rotationally driving the pinion 2 and via the pinion 2 the ring gear 3 meshing therewith. A direction of rotation is indicated by arrows P. The ring gear 3 is rotatably supported by a plain bearing in a bearing ring 5.

Opposite a circumferential portion in which the pinion 2 meshes with the ring gear 3, the internal gear pump 1 comprises a crescent-shaped clearance space, which is here referred to as a pump chamber 6. A likewise crescent-shaped separator 7, which divides the pump chamber 6 into a suction chamber 8 and a delivery chamber 9, is arranged in the pump chamber 6. The suction chamber 8 communicates with a pump inlet 10, which takes the form of a bore and which opens laterally, that is to say axially parallel to the internal gear pump 1, into the suction chamber 8 of the pump chamber 6 from one side. The delivery chamber 9 communicates with a pump outlet 11, which likewise takes the form of a bore and which opens into the delivery chamber 9 of the pump chamber 6 from one side.

The separator 7 bears with a concave inner side on tooth tips of teeth of the pinion 2 and with a convex outer side on tooth tips of teeth of the ring gear 3, so that it encloses fluid in tooth spaces between the teeth of the pinion 2 and the ring gear 3. In a manner known in the art of internal gear pumps, rotational driving of the gear wheels 2, 3 when the internal gear pump 1 is in operation thereby causes fluid to be delivered from the suction chamber 8 into the delivery chamber 9. In the proposed use of the internal gear pump 1 in a vehicle hydraulic brake system the fluid delivered is brake fluid.

At its longitudinal or circumferential center the separator 7 has an oval, radially aligned hole 12, by which it is held on a pin 13, which passes through the separator 7 axially parallel to the gear wheels 2, 3 of the internal gear pump 1 and which is immovably fixed in the internal gear pump 1. The oval hole 12 at the center of the separator 7 is as wide as a diameter of the pin 13, which passes through the hole 12, so that the separator 7 is held, preventing it from moving in a circumferential direction in the pump chamber 6 of the internal gear pump 1, and the oval hole 12 in the separator 7 is somewhat longer than the diameter of the pin 13, which passes through the hole 12, so that the separator 7 is moveable in a radial direction of the internal gear pump 1. The oval hole 12 is only one or a few millimeters, or less than one millimeter longer than the diameter of the pin 13, so that the separator 7 is radially movable to said degree in the pump chamber 6. In addition, the separator 7 is capable of pivoting about the pin 13; a geometrical axis of the pin 13 is at the same time the pivot axis of the separator 7.

The bearing ring 5 is slightly moveable in a pump housing 16 in the plane of the gear wheels 2, 3 and of the separator 7. At a point on a circumference of the bearing ring 5, yet to be explained, the internal gear pump 1 comprises a pin 14, the geometrical axis of which forms a pivot axis 18, about which the bearing 5 is capable of pivoting. The pin 14 is held parallel to the axes of rotation of the pinion 2 and the ring gear 3 in a bore in the pump housing 16 of the internal gear pump 1, and lies with approximately one half of its diameter in a complementary groove in the outer circumference of the bearing ring 5. The pivot axis 18 of the bearing ring 5 need not be situated on the outer circumference of the bearing ring 5 but may also be situated further outwards or further inwards. It is also feasible for the pivot axis 18 of the bearing ring 5 to be situated inside the ring gear 3, but it is separated by an interval from the axis of rotation 19 of the ring gear 3, that is to say it is eccentric in relation to the ring gear 3 and the bearing ring 5. Between the pump housing 16 and the bearing 5 there is a gap 17, which surrounds the bearing ring 5 in order to allow the pivoting movement of the bearing ring 5 together with the ring gear 3 rotatably supported therein. In the exemplary embodiment the pump housing 16 is formed by a hydraulic block, of which a fragment enclosing the internal gear pump 1 is shown in the drawing. Such hydraulic blocks are known in wheel-slip controlled vehicle brake systems: besides hydraulic pumps, in this case the internal gear pump 1, these comprise other fitted hydraulic components such as solenoid valves, non-return valves, hydraulic accumulators, which are hydraulically interconnected by bores.

Viewed in a circumferential direction, the pin 14, which defines the pivot axis 18 of the bearing ring 5, is arranged between the pin 13, which passes through the oval hole 12 of the separator 7 and defines the pivot axis 20 of the separator 7, and a delivery chamber-side end 15 of the separator 7. In other words the pin 14, which defines the pivot axis 18 of the bearing ring 5, is arranged in a circular sector 21, which is defined by two radii 22 and 23, that is to say two straight lines, which intersect at the axis of rotation 19 of the ring gear 3, the suction chamber-side radius 22 intersecting the pivot axis of the separator 7 and the delivery chamber-side radius 23 intersecting the delivery chamber-side end 15 of the separator 7. The pin 14, which defines the pivot axis 18 of the bearing ring 5, is preferably arranged in a central area 24 of said circular sector 21.

A pressure prevailing in the delivery chamber 9 when the internal gear pump 1 is in operation acts internally on the ring gear 3 and thereby generates a torque about the pivot axis of the bearing ring 5, which is defined by the pin 14 on its external circumference. This torque acts upon the bearing ring 5 in a circumferential portion, which extends inwards from the pin 14 to the suction chamber 8 counter to the direction of rotation P of the ring gear 3. Tooth tips of teeth of the ring gear 3 are thereby pressed inwards into sealing contact against the convex outer side of the separator 7. The tooth tips of the teeth of the ring gear 3 press the separator 7 in the circumferential portion described inwards against tooth tips of teeth of the of the pinion 2, so that the concave inner side of the separator 7 bears against the tooth tips of the teeth of the pinion 2. In this way a good contact of the tooth tips of the teeth of the ring gear 3 and of the pinion 2 against the separator 7 and compensation for tolerances and wear are achieved.

Although it is proposed to arrange the pivot axis of the bearing ring 5 circumferentially offset from the pivot axis of the separator 7 in the direction of the delivery chamber 9, or closer to the delivery chamber-side end 15 than to the suction chamber-side end of the separator 7, in order that the tooth tips of the teeth of the ring gear 3 are pressed inwards over a long circumferential portion of the separator 7, this does fundamentally preclude the possibility of arranging the pivot axis of the bearing ring 5 closer to the suction chamber-side end of the separator 7 (not shown).

The internal gear pump 1 according to the disclosure is intended as a hydraulic pump of a hydraulic, wheel slip-controlled and/or power brake system of a vehicle (not shown), where it serves for forms of wheel slip control, such as antilock braking, traction control and/or electronic stability control and/or for generating brake pressure in hydraulic power brake systems of a vehicle. Such hydraulic pumps are also referred to, although not altogether correctly, as return pumps. The abbreviations ABS, ASR, ESC and ESP are commonly used in referring to said forms of wheel slip control. Forms of electronic stability control are also referred to colloquially as antiskid controls.

What is claimed is:

1. An internal gear pump, comprising:

a bearing;

an internally toothed ring gear rotatably supported in the bearing and having an axis of rotation;

an externally toothed pinion arranged eccentrically in the ring gear and configured to mesh with the ring gear in a circumferential portion; and a separator arranged in a crescent-shaped pump chamber of the internal gear pump, the separator being configured to bear against tooth tips of teeth of the pinion and of the ring gear and to divide the pump chamber into a suction chamber and a delivery chamber, the separator existing between the pinion and the ring gear opposite the circumferential portion in which the pinion meshes with the ring gear, and the separator being configured to pivot about a separator pivot axis, wherein the separator is moveable in a radial direction, wherein the bearing is supported such that the bearing pivots about a bearing pivot axis, which is arranged eccentrically in relation to the axis of rotation of the ring gear, such that a pressure of a fluid delivered by the internal gear pump prevailing in the pump chamber when the internal gear pump is in operation and acting internally on the ring gear exerts a torque on the bearing, which externally presses the ring gear against the separator, and wherein the bearing pivot axis is located in a central area of a circular sector defined between a first radius extending from the axis of rotation of the ring gear through the separator pivot axis and a second radius extending from the axis of rotation of the ring gear through a delivery chamber side end of the separator.

2. The internal gear pump according to claim 1, wherein the bearing comprises a bearing ring in which the ring gear is supported by a plain bearing.

3. The internal gear pump according to claim 1, wherein the separator is immovable in a circumferential direction.

4. The internal gear pump according to claim 1, wherein the separator is configured as one piece.

5. The internal gear pump according to claim 1, wherein the internal gear pump is configured for a vehicle hydraulic brake system.

6. The internal gear pump according to claim 1, wherein the central area of the circular sector is defined as approximately a central half of the circular sector defined circumferentially relative to the axis of rotation of the ring gear.

* * * * *